US007963493B2

(12) United States Patent
Vardaro et al.

(10) Patent No.: US 7,963,493 B2
(45) Date of Patent: Jun. 21, 2011

(54) DISPLAY ASSEMBLY

(75) Inventors: Enzo Vardaro, Montreal (CA); Antonio Vardaro, Montreal (CA)

(73) Assignee: Groupe Artitalia Inc., Montreal (CA)

( * ) Notice: Subject to any disclaimer, the term of this patent is extended or adjusted under 35 U.S.C. 154(b) by 1151 days.

(21) Appl. No.: 10/683,115

(22) Filed: Oct. 14, 2003

(65) Prior Publication Data

US 2004/0195480 A1 Oct. 7, 2004

(30) Foreign Application Priority Data

Oct. 11, 2002 (CA) ..... 2407782

(51) Int. Cl.
*A47B 47/00* (2006.01)

(52) U.S. Cl. ..... 248/241; 248/245; 248/200.1; 52/506.05

(58) Field of Classification Search ..... 248/200.1, 248/235, 241, 243, 244, 245, 246; 52/38, 52/511, 506.03, 506.05, 235
See application file for complete search history.

(56) References Cited

U.S. PATENT DOCUMENTS 4,791,873 A * 12/1988 Towfigh ..... 108/10
4,972,783 A * 11/1990 Crissman et al. ..... 108/107
5,688,087 A * 11/1997 Stapleton et al. ..... 410/150
5,921,411 A * 7/1999 Merl ..... 211/90.01
6,039,150 A * 3/2000 Palmer ..... 182/113
6,382,436 B1 * 5/2002 Wang ..... 211/207
6,425,563 B1 * 7/2002 Mihailoff ..... 248/245
6,863,188 B2 * 3/2005 Besserer et al. ..... 211/183
6,948,691 B2 * 9/2005 Brock et al. ..... 248/222.13

* cited by examiner

*Primary Examiner* — J. Allen Shriver, II
*Assistant Examiner* — Steven M Marsh
(74) *Attorney, Agent, or Firm* — Goudreau Gage Dubuc; Gonzalo Lavin

(57) ABSTRACT

A display assembly for displaying items and being mountable to a vertical surface and comprising at least two longitudinal runners and an elongate member. The longitudinal runners are mountable to the vertical surface. Each runner includes elongate-member-mounting elements. The elongate-member-mounting elements of at least one of the runners include a protrusion-receiving element. The elongate member includes one end mountable to one of the runners and an opposite end mountable to the other of the runners. The one end has a moveable protrusion assembly for releasably engaging the protrusion-receiving element. The opposite end is so configured and sized as to be mountable to the elongate-member-mounting elements. The elongate member includes display-member-engaging elements. The moveable protrusion assembly is moveable between a runner-engaging position for engaging the protrusion-receiving element and a runner-disengaging position for disengaging the protrusion-receiving element.

34 Claims, 7 Drawing Sheets

DISPLAY ASSEMBLY

FIELD OF THE INVENTION

The present invention relates to a display assembly. More specifically, the present invention is concerned with a shelving display assembly for displaying items.

BACKGROUND OF THE INVENTION

Display assemblies for shelving and displaying merchandise and other such articles are well known. There are many variations of such display assemblies used in supermarkets, grocery stores, drugstores and the like.

Prior art improvements include display assemblies with a pair of top and bottom runners, and a vertical elongate or post member being mountable therebetween, This post includes apertures for receiving bracket members that can carry a variety of shelves for displaying items. The posts may have pegs, pins, inserts or other protrusions that are configured to be inserted within corresponding apertures formed within the top and bottom runners.

Drawbacks with the prior art assemblies include that it is inconvenient to assemble and disassemble an elongate member from the runners and that the elongate member is not mounted to the runners with sufficient stability.

There thus remains a need for an improved display assembly.

OBJECTS OF THE INVENTION

An object of the present invention is therefore to provide an improved display assembly.

SUMMARY OF THE INVENTION

More specifically, in accordance with the present invention, there is provided a display assembly for displaying items and being mountable to a vertical surface, the display assembly comprising:

at least two longitudinal runners being mountable to the vertical surface, each of the runners including elongate-member-mounting elements, the elongate-member-mounting elements of at least one of the runners including a protrusion-receiving element; and an elongate member including one end mountable to one of the runners and an opposite end mountable to the other of the runners, the one end having a moveable protrusion assembly for releasably engaging the protrusion-receiving element, the opposite end being so configured as to mountable to the elongate-member-mounting elements, the elongate member including display-member-engaging elements;

whereby the moveable protrusion assembly is moveable between a runner-engaging position for engaging the protrusion-receiving element and a runner-disengaging position for disengaging the protrusion-receiving element.

The terms "first" and "second" are used herein for indicative purposes only and hence are interchangeable.

An advantage of the present invention is that it provides an improved display assembly that can be assembled and disassembled and that includes a safety locking mechanism.

Another advantage of the present invention is that the elongate-member is securely mounted between two runners.

Other objects, advantages and features of the present invention will become more apparent upon reading of the following non restrictive description of embodiments thereof, given by way of example only with reference to the accompanying drawings.

BRIEF DESCRIPTION OF THE DRAWINGS

In the appended drawings, in which like reference numerals indicate like elements throughout and in which.

DESCRIPTION OF THE EMBODIMENT

With reference to the accompanying drawings, the present invention will be herein described by way of embodiments for the purposes of exemplifying the invention only and not limitation.

Figure 1:
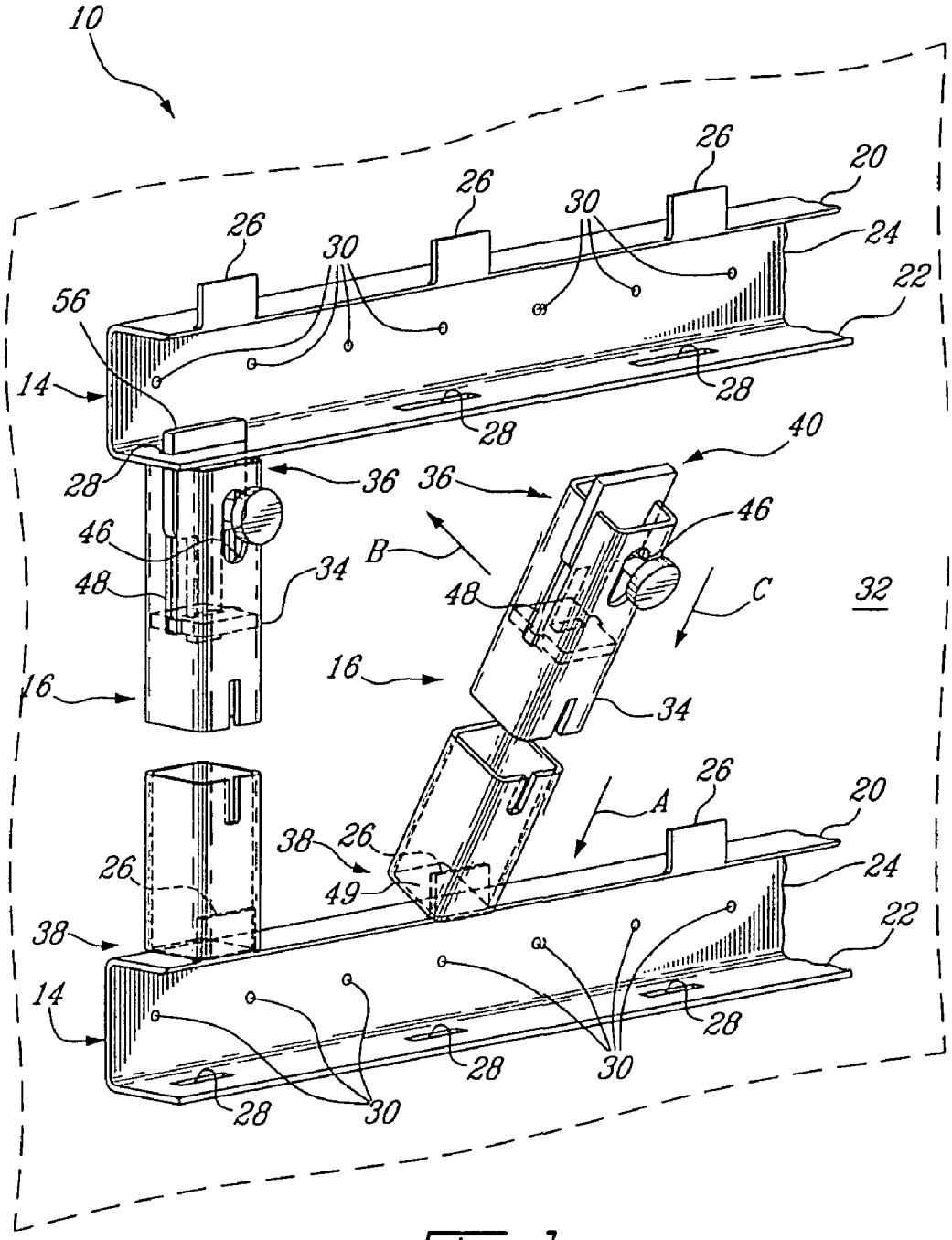
FIG. 1 is a perspective view of the display assembly in accordance with an embodiment of the invention.
Figure 2:
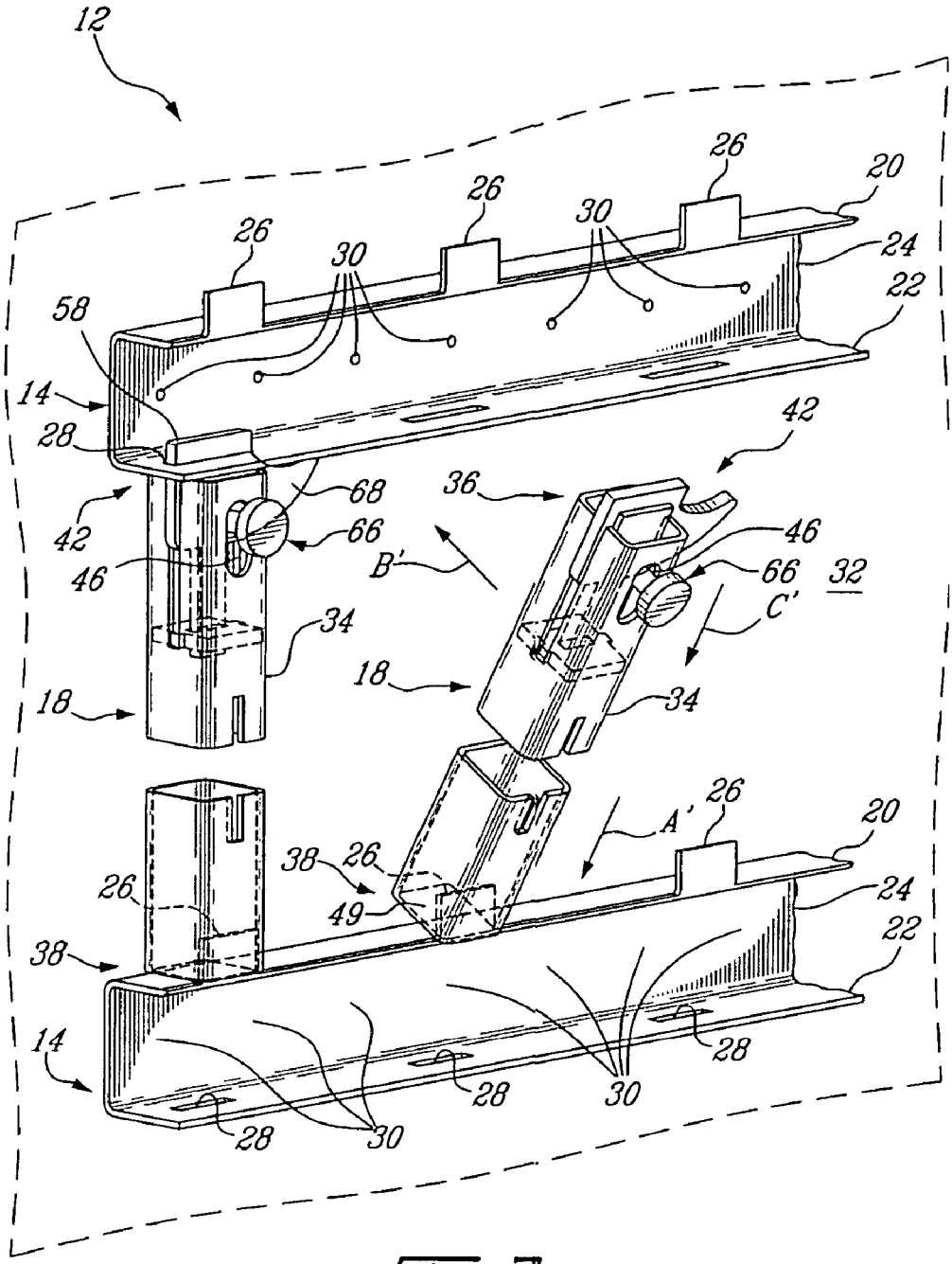
FIG. 2 is a perspective view of the display assembly in accordance with another embodiment of the present.

FIGS. 1 and 2 show display assemblies 10 and 12 respectively in accordance with two respective embodiments of the present invention.

Display assembly 10 includes two runners 14 and elongate-members 16 therebetween; display assembly 12 includes two runners 14 and elongate-members 18 therebetween.

The runners 14 are longitudinal structures. In the present illustrated non-limiting example runners 12 are open or c-shaped rectangular structures defining a channel formed by first and second side structures 20 and 22 respectively and a vertical surface engaging portion 24 therebetween.

Side structures 20 and 22 run generally parallel to each other. Side structure 20 includes elongate-member-mounting elements such as protrusions 26. Side structure 22 includes elongate-member-mounting elements that are protrusion-receiving elements 28 in the form of apertures.

The surface-engaging portion 24 includes apertures such as screw holes 30 for being mounted to a vertical surface such as a wall 32.

Each elongate member 16 and 18 includes a main body 34 with opposite first and second ends 36 and 38 respectively. It should be noted that the terms "first end" and "second end" are used herein for indicative purposes only and hence, are interchangeable.

With reference to FIGS. 1, 2, 3 and 4, the respective first end 36 of elongate members 16 and 18 includes a respective moveable protrusion assembly 40 and 42.

Turning back to FIGS. 1 and 2, the second end 38 of each elongate member 16 and 18 is mountable to a side structure 20 of a runner 14. In this respect, the second end 22 includes an aperture 44 for receiving a protrusion 26 therein.

With reference again to FIGS. 1, 2, 3 and 4, the main body 34 includes a lever-slot 46, side slits 48 near its first end 36 and display-member engaging elements in the form of slots 50.

In the present non-limiting illustrated example, the elongate members 16 and 18 are hollow tubes having a generally rectangular configuration.

Figure 4:
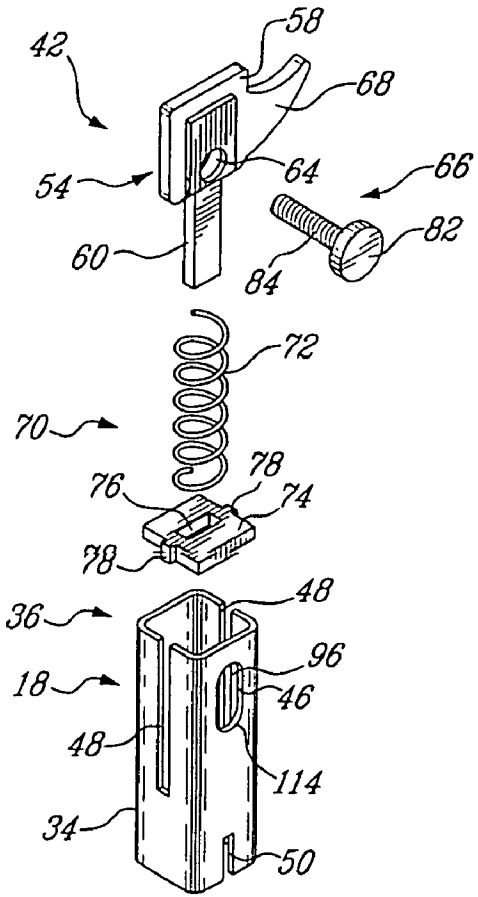
FIG. 4 is a perspective exploded view of the moveable protrusion assembly of FIG. 2.
Figure 3:
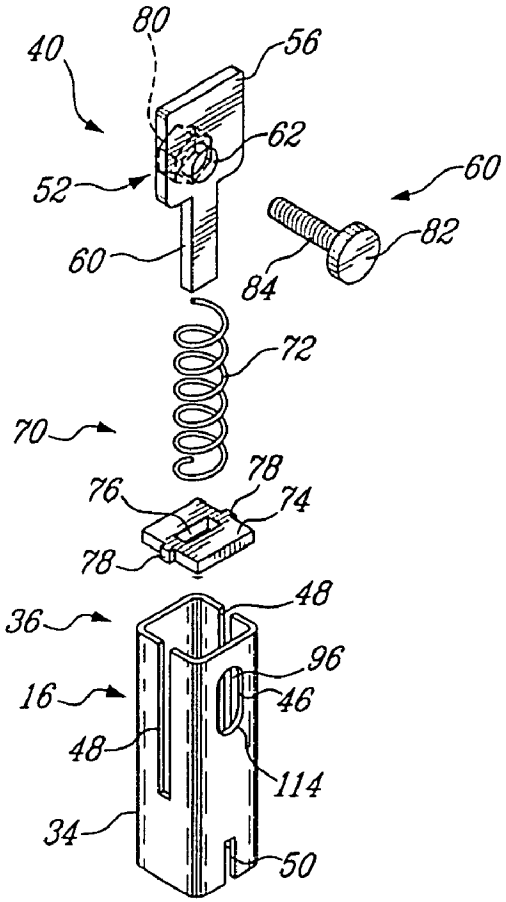
FIG. 3 is a perspective exploded view of the moveable protrusion assembly of FIG. 1.

As shown in FIGS. 3 and 4, the moveable protrusion assemblies 40 and 42 include respective protrusion members 52 and 54. Protrusion members 52 and 54 include respective runner-engaging portions 56 and 58 and respective base portions 60. In this example the runner-engaging portions 56 and 58 are tab portions and the base portions 60 are tail portions. The tab portions 56 and 58 have respective apertures 62 and 64 to receive a respective threaded screw 66 which acts as a lever and a stopper as will be explained below. Tab portion 56 also includes an extending member 68 that acts as a stabiliser or support and as a lever member as will be explained below.

Each moveable protrusion assembly 40 and 42 also includes a biasing assembly 70. The biasing assembly 70 includes a spring 72 and a pad member 74. The pad member 74 is a flat member with a central aperture 76 and side fins 78.

Figure 5:
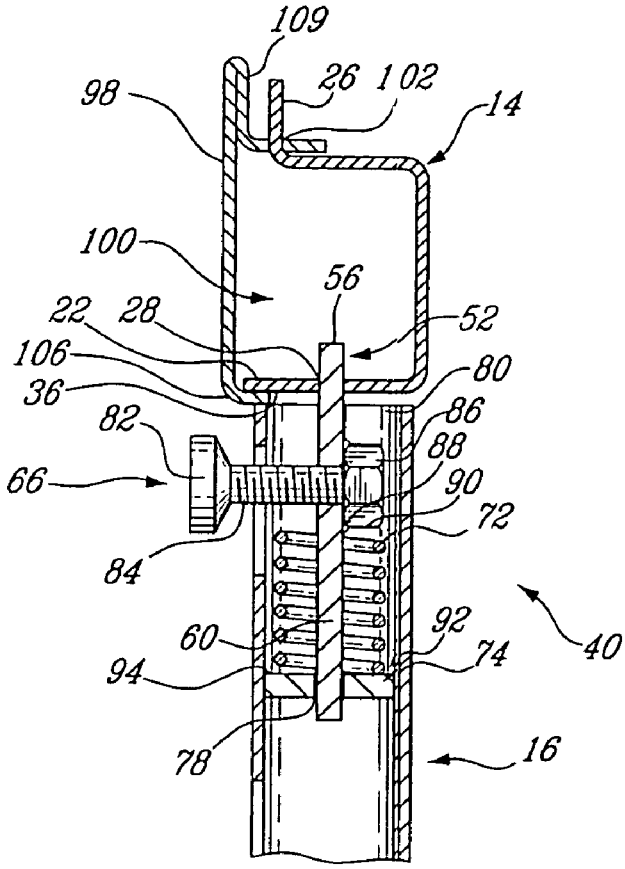
FIG. 5 is a side sectional view of a an elongate member engaging a runner in accordance with the embodiment of FIG. 1.
Figure 6:
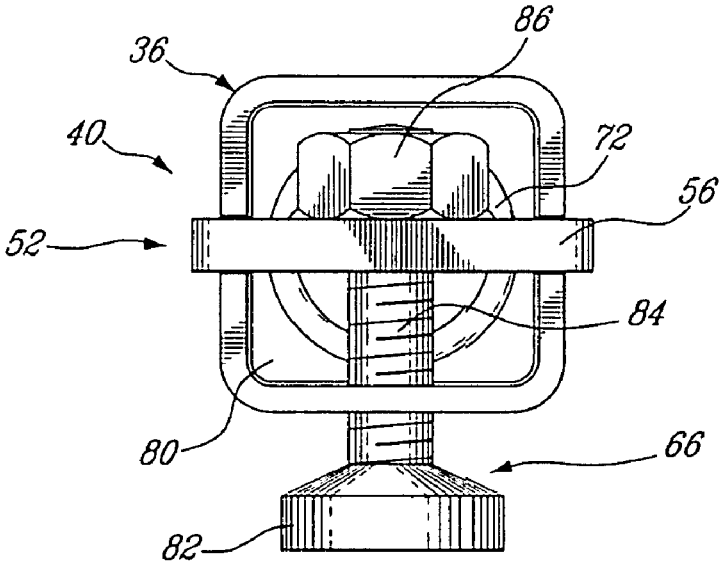
FIG. 6 is a top plan view of the elongate member of FIG. 1.

With particular reference to FIG. 5 and general reference to FIG. 6, when the protrusion assembly 40 is assembled and engages a given aperture 28 of a runner 14, the moveable protruding member 52 is biased to a runner-engaging position. In this way, the tab portion 56 protrudes outwardly through a protrusion aperture 80 at the first end 36 of the elongate member 18 by way of the biasing tension of spring 72.

As aforementioned, the protrusion member 52 includes a lever 66. This lever 66 includes a head 82 and a threaded fastening portion 84 fixedly mounted to the protrusion member's tab portion 56 through its aperture 62 via a bolt 86. The lever head 82 outwardly protrudes through the lever slot 46.

The pad member 74 is housed within the main body 34 of the elongate member 18 with its fins 78 engaging the elongate member side slits 48 and its central aperture 76 receiving the tail portion 60 therethrough.

The biasing spring 72 is mounted to the protruding member 52 about its tail portion 60. The spring 72 abuts at one end 88 thereof a first stopper structure 90, formed by the bolted lever 66; the spring abuts at another end 92 thereof a second stopper 94, defined by the body of pad member 74.

In this way, the spring 72 is sandwiched between a shoulder formed by the lever's threaded portion 84 and bolt 86 and the pad member 74, which respectively define first and second stoppers 90 and 94. Consequently, the spring biases both the lever 66 and the tab portion 56 towards the runner engaging position.

The lever 66 also acts as a protrusion member stopper, providing for the protrusion member 52 not to be disassembled from the protrusion assembly 40, since it abuts an edge 96 (see FIGS. 3 and 4) of slot 46 which is near the elongate member's protrusion aperture 80.

The protrusion assembly 42 is assembled in a similar fashion, which will not be described herein for concision purposes only.

In this way and as will be further explained when the invention is described in operation, the moveable protrusion assemblies 40 and 42 are moveable between runner engaging and runner disengaging positions.

As stated above and with respect to FIGS. 2 and 4, the protrusion assembly 42 includes an extension 68, which has a hook like form. The extension 68 functions as a lever providing the user to push the protruding member 58 against the spring 72 bias. Extension 68 also functions as a stabiliser by defining a runner-abutting portion such as the hook tip 69 which abuts the runner side 22 when the protrusion assembly 42 is in the runner engaging position.

Figure 7:
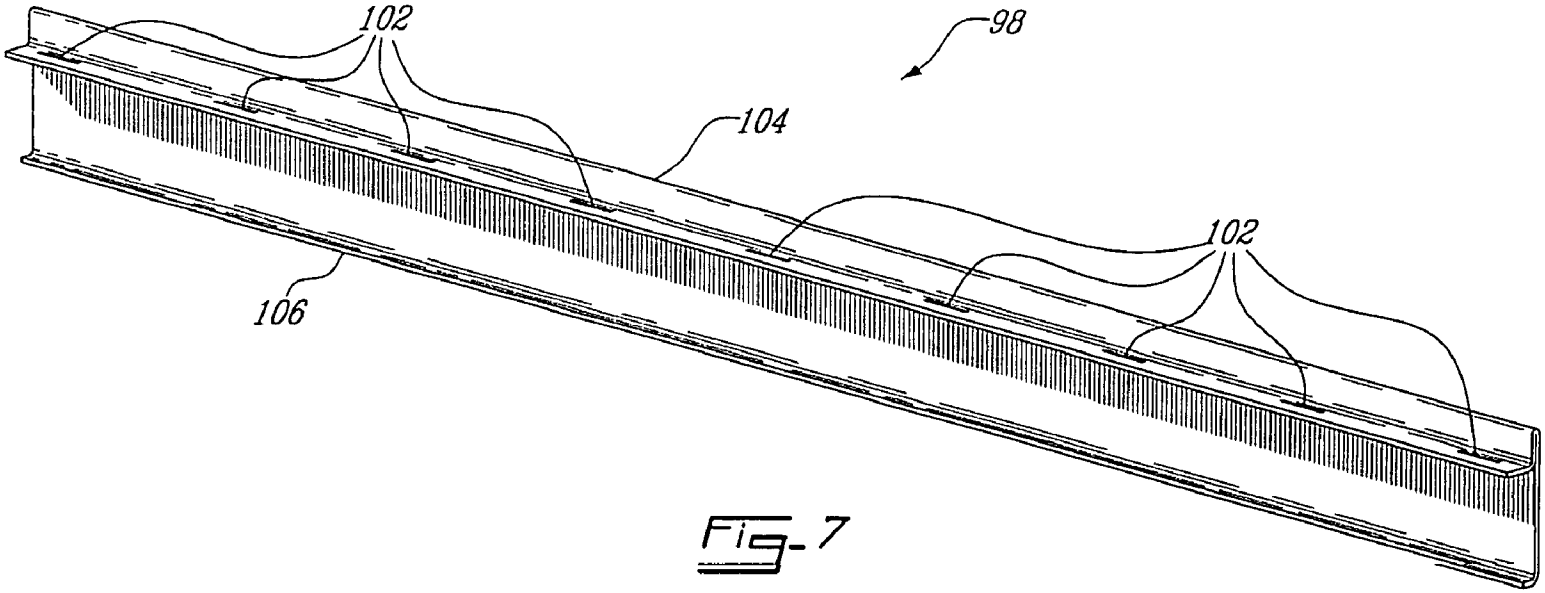
FIG. 7 is a perspective view of a runner cover in accordance with an embodiment of the present invention.

With reference to FIGS. 5 and 7, the display assembly 10 also includes covers 98 for covering the open front side 100 of runners 14. Covers 98 include apertures 102 configured to receive protrusions 26 therein when the cover is mounted to a runner 14. The covers 98 also include an extension 104 and flange 106. The extension 104 covers any jagged edges on the runner formed by the protrusions 26. The flange is wedged between the side 22 of a runner 14 and the first end 36 of an elongate member 16 or 18 mounted to that runner 14.

Figure 8:
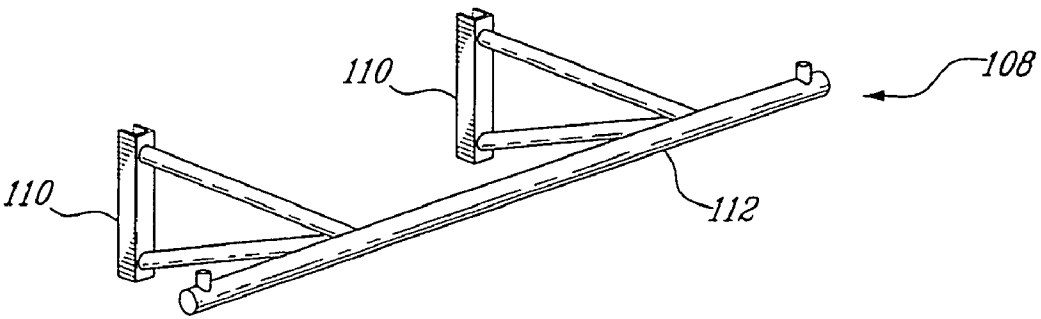
FIG. 8 is a perspective view of a display element in accordance with an embodiment of the present invention.

With reference to FIG. 8, the display assembly 10 also includes display members 108 for displaying the items being mountable to the display-member-engaging elements 52. The display members 108 include mounting elements 110 configured to engage elements 52. Display elements 108 also include a display portion 112 configured to hang items therefrom of to mount a shelf member (not shown) thereon as is known in the art.

Keeping the above description in mind and with reference again to the accompanying drawings, the invention will now be described in operation.

The runners 14 are mounted to a vertical surface 32 such as a wall via fasteners (not shown) such as screws screwed into the wall 32 through screw-holes 30.

In this non-limiting example, the runners 14 are mounted generally horizontally on the wall. At least two runners 14 are mounted to the wall 32 and run generally parallel to each other at a distance that provides for the elongate members 16 and 18 to be generally vertically mounted therebetween as will be explained hereinbelow. In this way, there is provided top and bottom runners 14.

As explained above the elongate members 16 and 18 are configured to be mounted between two runners 14.

As shown, by arrows A and A' in FIGS. 1 and 2 respectively, the second end aperture 49 of elongate members 16 and 18 engage protrusions 26 of the bottom runner 14. As shown by arrows B and B' in FIGS. 1 and 2 respectively, the first end 36 of a given elongate member 16 and 18 is moved toward a respective top runner aperture 28. In each case, a moveable protrusion assembly 40 and 42 is positioned directly beneath respective and corresponding protrusion receiving elements 28 by pressing down a lever 66 as show by arrows C and C' respectively. Again in each case, upon the user's release of the respective levers 66, the tab members 56 and 58, being spring-biased toward the runner-engaging position, outwardly protrude, engaging a respective aperture 28 therethrough, beyond a given top runner side 22.

The foregoing ensures that elongate members 16 and 18 do not unintentionally disengage their respective runners when interlocked therewith.

In order to disengage the elongate member 16 and 18 from their respective top and bottom runners 12, the user lowers their respective tab portions 56 and 58 by downwardly pushing their respective levers 66, as shown by arrows C and C', along slot 46 towards a bottom edge 114 thereof (see FIGS. 3 and 4), against the biasing tension of spring 72, moving the moveable protrusion assemblies 40 and 42 to the runner disengaging position and hence, freeing top ends 36.

Figure 9:
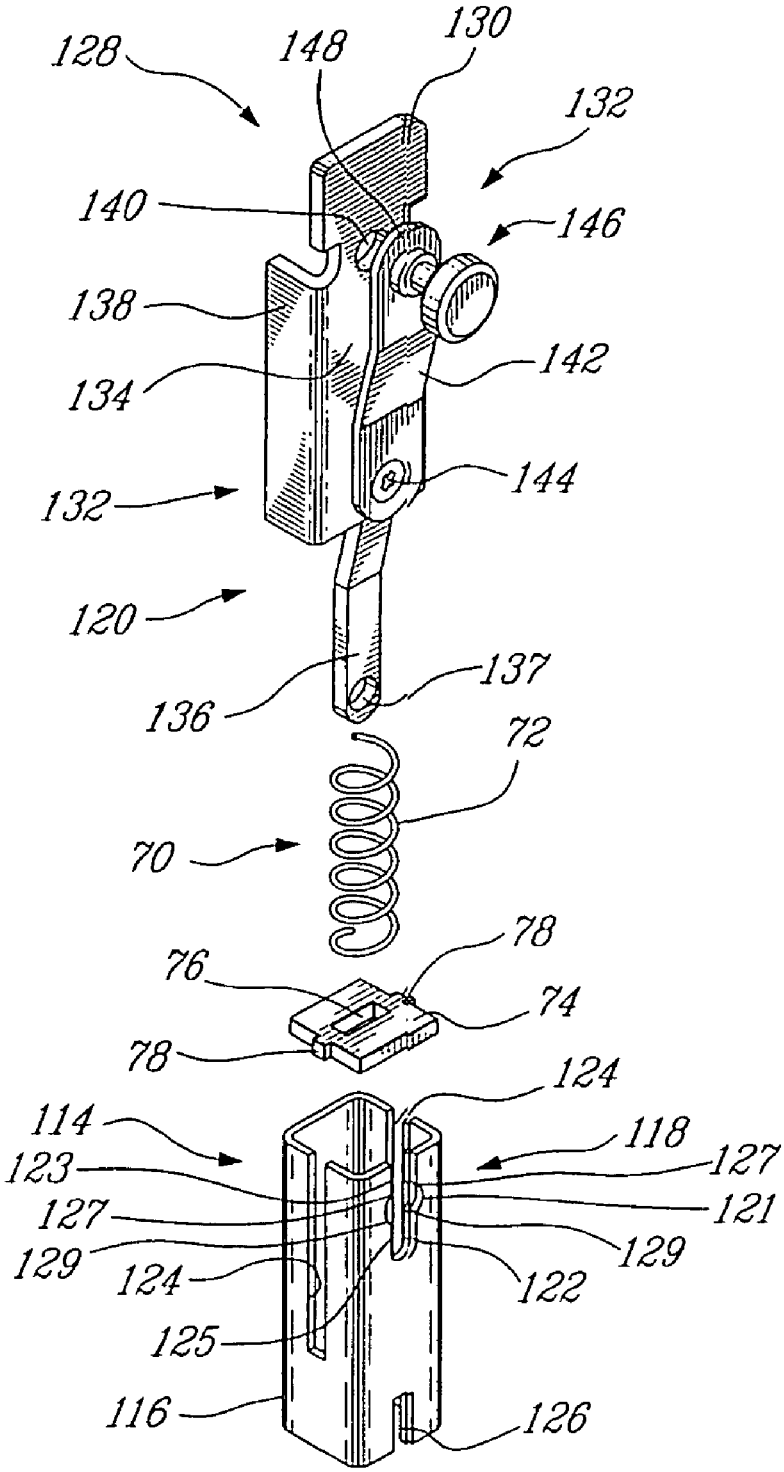
FIG. 9 is a perspective exploded view of the moveable protrusion assembly in accordance with a further embodiment of the invention.
Figure 10:
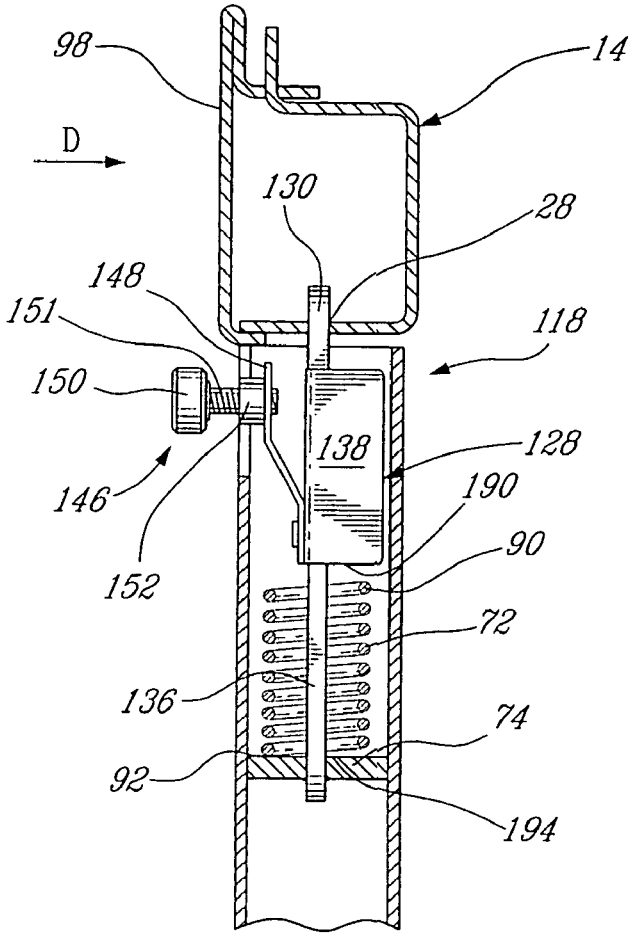
FIG. 10 is a side sectional view of a an elongate member engaging a runner with the moveable protrusion assembly of FIG. 9.
Figure 11:
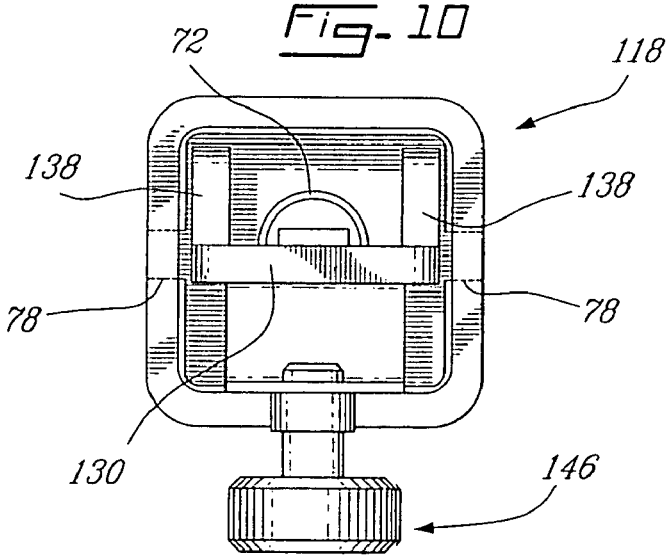
FIG. 11 is a top plan view of the elongate member of FIG. 1.

With reference to FIGS. 9 through 11, a further embodiment of the post or elongate member of the present invention will be herein described.

FIG. 9 shows an elongate member 114. Elongate member 114 is an alternative to elongate members 16 and 18 and hence can replace them in display assemblies 10 and 12 respectively. The elongate member 114 includes a main body 116 with opposite first and second ends. Only the first and 118 is shown here. The first end defines a protrusion aperture 119. The second end (not shown) is similar to the second end 38 of both members 16 and 18 previously described.

The first end 118 includes a moveable protrusion assembly 120.

The main body 116 includes a lever slot 122 near its first end 118, opposite side slits 124, and a display engaging elements in the form of slots 126.

The lever slot 122 includes a central lever aperture 121 and upper and lower slot portions 123 and 125 respectively. Top shoulders 127 are defined between the central aperture 121 and the top slot portion 123, bottom shoulders 129 are defined between the bottom slot portion 125 and the central aperture.

Again, in the present non-limiting illustrated example, the elongate member 114 is a hollow tube having a generally rectangular configuration.

The moveable protrusion assembly 120 includes a protruding member 128, which includes a runner engaging portion 130 and base portion 132. The runner-engaging portion 130 is in the form of a tab. The base portion 132 includes a main body 134 and a tail portion 136 downwardly extending therefrom and ending off with an aperture 137. The main body 134 also includes side flanges 138 (only one flange is shown here) and an aperture 140 near the tab portion 130.

The moveable protrusion assembly 128 also includes a lever assembly 141.

The lever assembly 141 includes a pushable lever-biasing member 142 which is mounted to the base portion main body 134 at its lower end 144, and which carries a lever 146 at its top end 148. The lever 146 includes a head 150 and a threaded fastening portion 151 fixedly mounted to the lever-biasing member 142 via a bolt 152.

The protrusion assembly 128 also includes a biasing assembly 70 that is similarly constructed to the previously described biasing assemblies and hence will not be described in greater detail for concision purposes only. It should be noted that the flat pad member 74 also includes fins 78, which engage the side slots 124. It should also be noted that the central aperture 76 is configured to receive the tail portion 136 therethrough.

Turning to FIG. 10, when the protrusion assembly 120 is assembled and housed in the first end 118 of the elongate member 114 and engages a given aperture 28 of a runner 14, the moveable protruding member 132 is biased to a runner-engaging position. In this way, the tab portion 130 protrudes outwardly through the protrusion aperture 119 at the first end 118 of the elongate member 114 by way of the biasing tension of spring 72.

The lever head 150 forwardly protrudes from the central aperture 121 by way of the biasing member 142. The bolt 152 on the threaded portion 152 partially outwardly protrudes from the central aperture 121 and engages the upper and bottom shoulder 127 and 129 respectively. In this way, the lever bolt 152 acts as a stopper disallowing the lever member 146 from sliding up the slot portion 123 by way of the tension spring force. The stopper bolt 152 further avoids the lever member 146 from being easily pushed down along the bottom slot portion 125 and to disengage the tab 130 from a runner aperture 28. Hence, the configuration of the stopper 152 is such that it cannot be moved along the upper and lower slot portions 123 and 125.

The pad member 74 is housed within the main body 116 of the elongate member 118 with its fins 78 engaging the elongate member side slits 124 and its central aperture 76 receiving the tail portion 136 therethrough.

The biasing spring 72 is mounted to the tail portion 136. The spring 72 abuts at one end 88 thereof a first stopper structure 190 formed by the protruding member main body; the spring abuts at another end 92 thereof a second stopper 194, defined by the body of pad member 74.

In this way, the spring 72 is sandwiched between a shoulder formed by the protruding member main body 134 and the pad member 74, which respectively define first and second stoppers 190 and 194. Consequently, the spring biases both the protruding member 128 including the tab portion and the lever assembly 141 towards the runner engaging position.

The lever 141 also acts as a protrusion member stopper, providing for the protrusion member 128 not to be disassembled from the protrusion assembly 120 since it abuts the upper shoulders 127 of slot 122 when in the runner-engaging position.

In operation, the elongate member 114 is mounted to runners 14 similarly to the mounting of elongate members 16 and 18 to runners 14 described above and hence, only the different features of elongate member 114 will be pointed out for concision purposes only.

In order for the first end 118 of the elongate member 114 to engage an aperture 28 of a runner 14, the user presses or pushes the lever head 150 inwardly against the biasing force of biasing member 142 as shown by arrow D in FIG. 10. This causes the bolt stopper 152 to disengage the shoulder 127 and 129 and to be pushed into the elongate member hollow main body 116 hence, aligning the threaded portion 151 with slot portion 125. Then, the user pushes the lever downwardly against the biasing force of spring 72 moving the threaded portion along the lower slot 125 simultaneously lowering the protruding member 120 and the tab 130.

As for elongate members 16 and 18, once the second end (not shown) has engaged one runner (not shown) the first end 118 will be brought under the other runner. The moveable protrusion assembly 120 is positioned directly beneath a corresponding protrusion receiving elements 28. Upon the user's release of the lever 146, the tab members 139 being spring-biased toward the runner-engaging position, outwardly protrudes from aperture 119 engaging a corresponding aperture 28 beyond a given top runner side 22. As the lever 146 is released the threaded portion 151 slides up the lower slot portion 125 to the central aperture 121, at this moment the bolt stopper 152 is pushed outwardly of aperture 121 by way of the biasing force of biasing member.

In order to disengage the elongate member 114 the user simply pushes the lever 46 in the direction shown by D and downwardly slides the threaded portion 151 along the lower slot 125 as shown by arrow E thereby, lowering the protruding member 128 and hence, disengaging the tab 130 from aperture 28.

Having described embodiments of the invention as well as the operation of these embodiments, a variety of alternative embodiments will be described hereinbelow so as only further exemplify the invention and not limit its scope.

The display assembly 10 described herein may be mounted to a variety of vertical surfaces such as a wall 32 or any other shelving or display surface for commercial or non-commercial uses as is commonly known in the art. Accordingly, the display assembly 10 may be used to display a variety of items.

Each longitudinal runner 14 may be provided in a variety of suitable sizes and configurations and be made of a variety of suitable materials. In the non-limiting example shown herein, the runners 14 are generally rectangular members; of course the skilled artisan may contemplate a semi-circular or arc-like configuration or flat like structures having top and bottom sides for example. The various runners 14 that can be contemplated within the scope of the present invention may be mounted to a vertical surface in a variety of ways known in the art, for example, via adhesive material. Furthermore, runners 14 may include a varying number of elongate-member-mounting elements and/or protrusion receiving elements.

The elongate members 16, 18 and 114 may be provided in a variety of suitable configurations, sizes and materials depending on the ultimate use of the present display assembly 10. Hence, the elongate members 16, 18 and 114 may be longer or shorter post members of wider panel members. Furthermore, elongate members 16, 18 and 114 may be provided in any form of metal or wood panel or tube, be it for decoration of for hanging other elements therefrom. Such panels may include for example, puck walls, slat walls, perforated panels and the like, as can be contemplated by the skilled artisan. Accordingly, the person having skilled in the art may also contemplate various conventional types of display elements 108 such as shelving assemblies and the like as is known in the art. Furthermore, the size and configuration of the second end 38 dimay vary in order to engagibly correspond with other types of elongate-member-mounting elements 26 as can e contemplated by the skilled artisan.

The side structures 20 and 22 of runners 14 may be reversed and as such the first end 36 of a given elongate member 16 and 18 may be a bottom end including a respective protrusion assembly 40 and 42 and the second end 38 may be a top end mountable to a top runner elongate-member-mounting element.

The moveable assemblies 40, 42 and 120 may also be provided in a variety of configurations which provide a safety locking mechanism in order to securely mount an elongate member 16 or 18 between two runners.

The protruding members 52, 54 and 120 may be designed in a variety of ways that can be contemplated by the skilled artisan without departing from the scope of the invention. Instead of tab portions 56, 58 and 130 the protruding members may include without limitation spherical, cylindrical, rectangular, triangular protrusions or other peg or key-like members or pin members or short protuberances and the like that can be contemplated by the skilled artisan. Correspondingly, the protrusion-receiving elements 28 may be also provided in a variety of configurations and sizes for receiving a given protrusion member such as without limitation slots, a group of small apertures for receiving pins, various indents for receiving any suitable protruding structures and the like.

Furthermore, the biasing member 142 may be provided in a variety of suitable designs. In another embodiment the biasing member is a spring member. A variety of tension and biasing elements, members and means can be used to bias a lever member 146 out of lever slot 122.

It will also be easily understood by the skilled artisan, that a variety of biasing assemblies 70 may be used to bias a variety of differently sized and configured protrusion members 52 and 54 to interlock with suitably sized and configured protrusion-receiving elements 28. For example, the biasing member 72 may not necessitate the use of a pad member 74 and may be directly mounted to a suitably constructed elongate member 16 or 18.

Moreover, levers 66, 68 146 may include any type of manual control switch that can disengage a protrusion member from its corresponding protrusion receiving element.

It should also be noted that the extension 68 might also be provided in a variety of shapes, sizes and materials for stabilising as explained above.

The display assembly 10 may include a greater number of runners 14 mounted to a surface 32 with at least one or more elongate-members 16 or 18 being mounted therebetween.

Furthermore, runners 14 may be vertically mounted to a surface 32 and elongate members 16 and 18 may be horizontally mounted therebetween with display elements extending therefrom in another non-limiting example.

The ordinarily skilled artisan, within the scope of the present invention, may also contemplate various covers and display elements such as and without limitation shelving assemblies, hanging-assemblies and the like.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of embodiments thereof; it can be modified, without departing from the spirit, scope and nature of the subject invention as defined in the appended claims.

We claim:

1. A display assembly for displaying items and being mountable to a vertical surface, said display assembly comprising:

at least two longitudinal runners being mountable to the vertical surface, each of said runners including elongate-member-mounting elements, said elongate-member-mounting elements of at least one of said runners including a protrusion-receiving element; and an elongate member including a first end mountable to one of said runners and a second end mountable to the other of said runners, said first end having a moveable protrusion assembly for releasably engaging said protrusion-receiving element along an axial direction substantially perpendicular to the longitudinal runners, said second end being so configured as to be mountable to said elongate-member-mounting elements, said elongate member including display-member-engaging elements;

wherein when said moveable protrusion assembly is moved between a runner-engaging position and a runner-disengaging position, said first end may be moved away from the vertical surface thereby disengaging said protrusion-receiving element from said runner, wherein said moveable protrusion assembly includes a protruding member and a biasing assembly biasing said protruding member to said runner-engaging position, and wherein said protrusion assembly includes a lever member for moving said protruding member to said runner-disengaging position against said biasing assembly.

2. A display assembly according to claim 1, further comprising a display member for displaying the items and being mountable to said display-member-engaging elements.

3. A display assembly according to claim 2, wherein said display member is integrally mounted to said elongate member.

4. A display assembly according to claim 1, wherein said protrusion-receiving element is an aperture.

5. A display assembly according to claim 1, wherein said one end of said elongate member, which includes said protruding member, includes an aperture providing said protruding member to protrude therethrough.

6. A display assembly according to claim 5, wherein said protruding member includes a runner-engaging portion for protruding through said one end aperture and a base portion housed within said elongate member.

7. A display assembly according to claim 1, wherein said protrusion assembly includes a lever biasing member biasing said lever member away from said elongate member.

8. A display assembly, according to claim 7, wherein said protruding member includes a main body including said lever-biasing member.

9. A display assembly according to claim 7, wherein said lever-biasing member carries said lever member.

10. A display assembly according to claim 7, wherein said lever-biasing member is mounted to said protruding member.

11. A display assembly according to claim 10, wherein said lever-biasing member is mounted to said protruding member at one end thereof and carries said lever member at another end thereof.

12. A display assembly according to claim 7, wherein said protrusion assembly is housed within said elongate member, said elongate member including a lever slot, said lever-biasing member biasing said lever member so as outwardly protrude from said lever slot.

13. A display assembly according to claim 12, wherein said lever member is moveable along said lever slot for moving said protruding member to said runner-disengaging position against said biasing assembly.

14. A display assembly according to claim 12, wherein said lever member includes a stopper for stopping the movement thereof along said lever slot.

15. A display assembly according to claim 14, wherein said lever slot defines a shoulder portion, said lever stopper abutting said portion, said lever member being moveable against the biasing force of said lever-biasing member so as to disengage said lever stopper from said slot shoulder.

16. A display assembly according to claim 1, wherein said protruding member includes a tail member, said biasing member mounted about said tail member abutting one stopper at one end thereof and another stopper at another end thereof.

17. A display assembly according to claim 16, wherein said one stopper is a shoulder formed by said protruding member.

18. A display assembly according to claim 17, wherein said another stopper is formed by a pad member.

19. A display assembly according to claim 17, wherein said pad member includes an aperture, said base portion extending through said pad aperture.

20. A display assembly according to claim 1, wherein said biasing assembly includes a spring member.

21. A display assembly according to claim 1, wherein said protruding member is housed within said elongate member, said lever mounted to said protruding member, said elongate member including a slot, said lever member outwardly extending from said slot.

22. A display assembly according to claim 21, wherein said slot includes an upper edge, said lever abutting said upper edge when said protruding member is in said running-engaging position stopping said protrusion assembly from disassociating from said elongate member.

23. A display assembly according to claim 21, wherein said runner-engaging portion includes a tab portion and said base portion includes a tail portion, said protrusion-engaging element including an aperture configured to receive said tab portion.

24. A display assembly according to claim 1, wherein said biasing-assembly includes a biasing member abutting a first stopper at one end a second stopper at another end.

25. A display assembly according to claim 24, wherein said first stopper is defined by said lever.

26. A display assembly according to claim 24, wherein protruding member includes a top portion and a base portion, said biasing member mounted to said base portion, said second stopper being a pad member including a central aperture for receiving said base portion therethrough.

27. A display assembly according to claim 23, wherein, said stopper is a lever member being moveable towards an opposite edge of said side-slot against the biasing member positioning said protruding member to said runner-disengaging position.

28. A display assembly according to claim 6, wherein said runner-engaging portion includes a lever extending therefrom.

29. A display assembly according to claim 6, wherein said runner-engaging member includes a runner-abutting portion extending therefrom.

30. A display assembly according to claim 1, wherein said runner includes first and second opposite side structures and a wall engaging portion therebetween; at least one of said first and second opposite side structures including said elongate-member-mounting elements.

31. A display assembly according to claim 30, wherein said first side structure of one said runner includes protrusions and said second side structure of the other of said runners includes said protrusion-receiving element.

32. A display assembly according to claim 31, wherein said opposite end of said elongate member includes an aperture for receiving said protrusion therein.

33. A display assembly according to claim 31, wherein said runner includes an open front side, said display assembly further comprising a runner cover including runner engaging elements for covering said runner open front side.

34. A display assembly according to claim 1, wherein said two runners are top and bottom runners generally horizontally mounted to said vertical surface, said elongate member being generally vertically mounted between said top and bottom runners.

* * * * *